US009016017B2

(12) United States Patent
Ryden

(10) Patent No.: US 9,016,017 B2
(45) Date of Patent: Apr. 28, 2015

(54) SYSTEM AND COVER ELEMENT FOR AIR SEALING

(75) Inventor: Birgitta Ryden, Ljungbyhed (SE)

(73) Assignee: Saint-Gobain Isover AB, Billesholm (SE)

( * ) Notice: Subject to any disclaimer, the term of this patent is extended or adjusted under 35 U.S.C. 154(b) by 646 days.

(21) Appl. No.: 12/645,570

(22) Filed: Dec. 23, 2009

(65) Prior Publication Data

US 2010/0263311 A1 Oct. 21, 2010

(30) Foreign Application Priority Data

Dec. 23, 2008 (SE) ..... 0802658

(51) Int. Cl.
*E04B 1/66* (2006.01)
*E04B 1/62* (2006.01)
*E06B 1/62* (2006.01)

(52) U.S. Cl.
CPC ..... *E04B 1/625* (2013.01); *E06B 2001/628* (2013.01)

(58) Field of Classification Search
CPC ..... E06B 1/62; E06B 2001/628; E06B 1/702; E04D 13/0315; E04B 1/66
USPC ..... 52/220.8, 58, 59, 60, 61, 62, 97, 287.1, 52/302.6, 717.01; 428/130, 122; 277/315, 277/316, 604, 606
See application file for complete search history.

(56) References Cited

U.S. PATENT DOCUMENTS 3,451,178 A * 6/1969 Beale ..... 52/210
4,667,702 A * 5/1987 Roth ..... 138/162
4,700,512 A * 10/1987 Laska ..... 52/58
5,018,333 A * 5/1991 Bruhm ..... 52/741.4
5,243,787 A * 9/1993 Mott et al. ..... 49/506
5,280,692 A * 1/1994 Patey ..... 52/716.2
6,401,401 B1 * 6/2002 Williams ..... 52/58
6,401,402 B1 6/2002 Williams
2003/0177710 A1 * 9/2003 Gatherum ..... 52/58
2004/0111981 A1 * 6/2004 Faurholdt et al. ..... 52/58
2005/0055890 A1 * 3/2005 Summy ..... 52/58
2006/0053699 A1 * 3/2006 Lolley et al. ..... 52/58
2006/0101726 A1 * 5/2006 Collins ..... 52/58
2008/0178557 A1 * 7/2008 Parsons et al. ..... 52/741.1
2011/0041432 A1 * 2/2011 Colwell et al. ..... 52/220.8

FOREIGN PATENT DOCUMENTS

WO WO 2005/068763 7/2005

OTHER PUBLICATIONS

International Search Report issued Jan. 9, 2008, in Swedish Patent Application No. 0701572-0, filed Jun. 29, 2007 (with English-language translation of categories).

* cited by examiner

*Primary Examiner* — Robert Canfield
*Assistant Examiner* — Matthew Gitlin
(74) *Attorney, Agent, or Firm* — Oblon, McClelland, Maier & Neustadt, L.L.P.

(57) ABSTRACT

A system for air sealing of leaks in building corners in a wall portion made up by a framework, including a cover element with two overlapping and plane flexible film portions, which are connected to each other along a first edge portion. The film portions include linear folding lines to enable unfolding of the cover element for forming a three-dimensional geometry including a main surface and a collar which projects from the main surface and is formed integrally therewith and which corresponds to three sides of the beam portion.

11 Claims, 9 Drawing Sheets

SYSTEM AND COVER ELEMENT FOR AIR SEALING

TECHNICAL FIELD

The present invention relates to a system and a cover element for air sealing of leaks in building corners and at an intersection between a wall portion and a beam portion projecting from the wall portion.

BACKGROUND ART

In the construction field there are a number of different types of external walls, such as stud walls of wood or steel and massive walls of, for example, concrete.

For exterior sealing for the purpose of preventing intrusion of water in a building foundation and for the provision of a wind shield, one solution is disclosed in U.S. Pat. No. 4,700,512. The document discloses a flexible membrane adapted for exterior sealing of a masonry building foundation. Yet, the membrane allows passage of air, admitting dehydration of the humidity that is naturally found in the building. Another solution to the same problem is found in U.S. Pat. No. 6,401,401 B1, disclosing a molded three-dimensional plastics geometry adapted to be mounted against a building corner on the exterior side of a wall portion.

The present invention relates however to interior sealing of buildings and more precisely air sealing of building corners with the purpose of creating an airtight vapour retarder/vapour barrier on the interior side of the building for improved energy consumption by reduced energy losses and controlled ventilation.

Massive concrete walls and plastered brick walls largely consist of inorganic material which is not particularly sensitive to moisture. Moreover they are in most cases very airtight and resist moisture very well, and therefore no additional air sealing with a separate vapour barrier or vapour retarder is usually considered necessary.

Other walls such as wood stud walls must be air sealed and protected from moisture. This type of wall in fact largely consists of organic material, such as wood and paper-coated gypsum boards, and is therefore very sensitive to the action of moisture. In order to further prevent damage due to moisture, reduce energy loss and control the ventilation in the building, thus improving the rational use of energy, the stud walls are provided with a diffusion- and airtight inside and a diffusion-open, windproof and rainproof outside. The diffusion and air seal consists of an airtight film with vapour retarder or vapour barrier properties and can be made of, for example, plastic film, aluminium foil, impregnated kraft paper or laminates of these materials. Laminates, if any, can be provided with a reinforcing carrier layer.

In mounting of the diffusion and air sealing film, problems arise, for example, in pipe lead-throughs and in irregularities/recesses in the wall structure, such as in windows and doors.

U.S. Pat. No. 5,243,787 discloses a simple method which is intended for solutions in which the window frame and the wall are positioned in the same plane. The diffusion and air sealing film is, according to the method, first stretched across the window, after which two diagonal cuts are made in the film so that four triangular flaps are formed. These flaps are then folded away from the window portion and fastened to the walls.

In the cases where the window frame and the wall are not positioned in the same plane but instead a window bay is formed, the above solution cannot be used. However, initially the same method as described above is used, that is the diffusion and air sealing film is stretched across the window and two diagonal cuts are made in the film so as to form four triangular flaps. Subsequently these flaps are folded into the window bay and fastened to its walls, after which residual material in the tips of the flaps is removed. In this method, there is however no diffusion and air sealing film in the corners, in the following referred to as building corners, at the basis of the flaps. In some cases, these portions, below referred to as leaks, are left without diffusion seal, resulting in zones that are not tight adjacent the windows with the risk of damage due to moisture, resulting in a great loss of energy. In most cases, these building corners are, however, sealed by means of pieces of diffusion and air sealing film. The leaks in the film that arise in any of these positions are usually sealed with adhesive tape, sealing strip or jointing material and pieces of film. By these building corners being three-dimensional, adhesive tape or sealing strip is attached along and frequently over an edge, which means that the originally two-dimensional tape/strip must be folded to follow the three-dimensional extent. This requires precision and patience and often tends to result in undesirable wrinkling. The greatest problem occurs at the point P at which three surfaces in the building corner coincide and easily several overlapping layers of adhesive tape are required. If the worst comes to the worst, this can result in difficulties in the subsequent mounting of cover panels and surface layers.

Traditionally there have been no guide lines and rules to how air sealing is to take place, which means that this takes place at the fitter's discretion. It is also difficult to inspect the quality of the work since walls, window bays etc are subsequently coated with additional material in the form of, for example, borders, panels, gypsum boards and other facings.

Furthermore, it is nowadays necessary to carry out pressure testing of many buildings, in particular low energy buildings, which are often referred to as "passive houses". Pressure testing occurs to prove that the seal is sufficient and to track any leaks before mounting panels and other facings. However, suitable air sealing elements to take care of any deficiencies are currently not available.

The above problems are associated not only with windows, but also appear in connection with other components, such as doors.

On the other hand, to prevent damage due to moisture, reduce energy loss and allow controlled ventilation in buildings at an intersection between a wall portion and a beam portion projecting from the wall portion, selected parts such as walls and intermediate floors may be provided with a diffusion and airsealing film.

An intermediate floor is a load-bearing component, which separates the different storeys of a building. The intermediate floor structure comprises a structural part, i.e. beams, floor and ceiling. The main function of the beams forming the structural framework is to carry the load of one storey and transferring the weight of this load onto the load-bearing walls and columns. The load is distributed via the floor structure, which consists of a plurality of beams extending across the building from one outer wall to the other. In the case of the top floor structure of a building, the intermediate floor is formed by roof trusses, which are arranged side by side.

To provide a suitable seal, the floor structure, beams and walls are clad, as stated above, with a diffusion and airsealing film. The cladding is applied before the floors and wall panels are mounted, which means that the film is stretched over the wall portions and the beams, respectively, of the intermediate floor. A consequence of this is that problems arise at the portion of the floor structure where it connects onto the wall, i.e. where each individual beam projects.

At such geometric intersections "patching and mending" is often employed, i.e. the fitter has no choice but to cut the film to the best of his ability and to patch and seal using individually cut pieces of leftover film, tape, sealing strips or jointing compound. Depending on the skill of the fitter, his awareness of the importance of the seal and whether he is pressed for time or not, there is a risk that some portions will not be sealed at all or will be inadequately sealed, which may result in damage due to moisture and considerable energy loss.

Traditionally there has been a lack of guidelines and standard specifications concerning the provision of airtight sealing, which means that the work of the fitter is based on arbitrariness. Furthermore, it is difficult to inspect the quality of the work since the walls and intermediate floor are subsequently clad in additional material in the form of, for example, skirting, panels, plasterboards, floorboards or other cladding.

Moreover, today pressure tests are required for many buildings, in particular for low-energy buildings, which are often referred to as "passive houses". The purpose of the pressure test is to document that the air tightness is sufficient and to trace any leakage before panels and other surface cladding are mounted.

OBJECTS OF THE PRESENT INVENTION

An object of the present invention is to provide a system and a cover element to be used for air sealing of leaks in building corners and adjacent the intersection between a wall portion and a beam portion projecting from the wall portion.

Another object of the invention is that the system and cover element should be a complete and simple solution that is quick and easy to mount.

A further object of the invention is that they should be easy to adapt to the current geometry of the surface to be sealed.

SUMMARY OF THE INVENTION

To achieve at least one of the above objects and also further objects not stated but that will appear from the following description, the present invention relates to a system for air sealing of leaks in building corners in a wall portion made up of a framework, comprising a cover element comprising at least two flexible film portions of an airtight film with vapour retarder or vapour barrier properties, which are interconnected along rim portions by means of linear weld joints, linear fold lines being arranged in said film portions to allow folding of the cover element to form a three-dimensional geometry consisting of three surfaces which meet at a point of intersection, and a diffusion and air sealing film attached to the wall portion, the three-dimensionally folded cover element being adapted to be fastened to said diffusion and air sealing film in said building corners for air sealing of said leeks.

The term building corner refers throughout in the following to structures in which at least three surfaces coincide so as to form a corner.

The term leak refers to defects, such as gaps, cracks, lead-throughs and incomplete overlappings in a surface that is intended to be airtight.

The inventive cover element can be provided in the form of a two-dimensional, essentially plane geometry, which makes it easy and cheap to distribute and handle up to mounting in which it is unfolded in one simple operation to form a three-dimensional geometry which directly or with simple cutting/folding can be mounted in a building corner.

The mounting of the cover element is simple since, when in its folded three-dimensional state, it forms large, essentially flat surfaces which can be arranged over and seal the leaks that arise when cutting and folding the diffusion and air sealing film which is initially mounted over the stud wall and the building corner. The time consuming and trying work of cutting and mounting extra pieces across the leaks can thus be eliminated. The only complementary work that is required is adjusting the cover element to the depth of the building corner in question and taping up the rim portions of the cover element to the surrounding surfaces with diffusion and air sealing film. This work, however, is quick and easy since all surfaces are large, flat and easy to reach. This increases the quality of the sealing work, which in turn greatly reduces the risk of deficient and careless sealing, resulting in a risk of, for instance, damage due to moisture and energy loss.

The design of the cover element is simple, which allows easy and inexpensive production. Moreover, one and the same size of the cover element can be provided and used since, in connection with mounting, the cover element can easily be adjusted to the depth of the building corner in question or to a building corner that is possibly not right-angled. The depth of the building corner can, for example, vary depending on the type and age of the building, building specifications, the make and type of the window/door.

In case of angular deviations, the cover element can easily, by being made of flexible film, be provided with new fold lines so as to fit in the building corner in question.

At least two of the weld joints can start from said point of intersection. Moreover, at least two of the fold lines can start from said point of intersection. Alternatively, both said fold lines and said weld joints can start from said point of intersection. The point of intersection forms the corner in which the three surfaces coincide when folding the cover element to its three-dimensional geometry. The fold lines and the weld joints act to make up the surfaces to form essentially flat surfaces of the three-dimensional geometry.

The three-dimensional folding can be arranged to occur by folding along at least four lines. At least two of the fold lines may consist of said weld joints. By letting the weld joints form fold lines, the number of fold lines can be reduced, which facilitates manufacture but also the folding of the cover element to its three-dimensional geometry.

The three surfaces forming the three-dimensional geometry may be three mutually orthogonal surfaces. This allows the cover element to be directly mounted in a right-angled building corner without adjustment by means of supplementary fold lines. The only adjustment that may be necessary is fitting the size of the surfaces depending on the depth of the building corner in question and desirable overlapping of the surrounding diffusion and air sealing film.

The flexible film portion may consist of an airtight vapour retarder material or a vapour barrier material, which is the same type of material as is normally used in the diffusion and air sealing films that are available on the market. This means that the fitter can quite easily use the same types of adhesive tapes, sealing compounds and the like as are already at his disposal for other sealing work. Furthermore, the properties of the final diffusion seal are not affected since no new type of material is added.

Said diffusion and air sealing film can have vapour retarder or vapour barrier properties.

Said cover element can comprise portions provided with adhesive along at least some of the rim portions of the three-dimensionally folded cover element.

Said cover element can have an oversized length of the parts of the rim portions which are adapted to be oriented toward the building corner during mounting.

In one embodiment, the cover element may comprise two film portions, which each have a geometry comprising a trapezoid which is provided with a right-angled corner and which changes into a right-angled quadrangle to form a straight first rim portion and an opposite angular second rim portion, the second rim portion comprising two weld joints which connect the two film portions and which meet at said point of intersection which is arranged along said second rim portion in the transition between the quadrangle and the trapezoid, and each film portion having a linear fold line which extends between the first and the second rim portion from the point of intersection, whereby two of the three surfaces, in folding to form said three-dimensional geometry, are formed by said right-angled quadrangle and the third surface is formed by said trapezoid by folding along said angular second rim portion and said linear fold lines.

This embodiment of the cover element is very simple in its design since it is made of two identical, overlapping film portions which are interconnected along a rim portion, which allows very simple and inexpensive manufacture.

In another embodiment, the cover element may comprise a first film portion in the form of a right-angled quadrangle folded in two and a second film portion which in its state folded in two has a trapezoid form provided with a right-angled corner, said first and second film portions being interconnected along two weld joints to form together a straight first rim portion and an opposite angular second rim portion, the fold lines of the first and the second film portion being joined at the point of intersection to form said second rim portion, and said weld joints extending between said first and second rim portions from the point of intersection, whereby two of the three surfaces, in folding to form said three-dimensional geometry, are formed by said right-angled quadrangle and the third surface is formed by said trapezoid by folding along said second rim portion and said weld joints.

In a further embodiment, the cover element may comprise a first film portion in the form of a first right-angled quadrangle, which by means of three fold lines and a slit is divided into four quadrants, which meet at a point of intersection, and a second film portion in the form of a right-angled triangle folded in two along the hypotenuse, the second film portion being, along two of its legs, connected by welding to the first film portion along both edges of said slit, whereby said legs coincide with the fold lines of the first film portion at the point of intersection, and whereby two of the three surfaces, in folding to form said three-dimensional geometry, are formed by two of said quadrants and the third surface is formed by the remaining two quadrants and said triangle three-dimensionally folded along the hypotenuse.

In a particular embodiment, the present invention relates to a system for airtight sealing of leaks at the intersection between a wall portion and a beam portion projecting from the wall portion, comprising at least one cover element, which comprises two flexible film portions, which film portions are connected to each other along edge portions, linear folding lines being arranged in said film portions to enable unfolding of the cover element for forming a three-dimensional geometry including a main surface and a collar which projects from the main surface and is formed integrally therewith and which corresponds to three sides of said beam portion, and a diffusion and airsealing film stretched over the wall portion, the unfolded cover element being adapted to be attached to said diffusion and airsealing film at said intersection for airtight sealing of said leaks.

By leaks is meant here defects such as gaps, cracks, penetrations and imperfect overlaps in a surface intended to be airtight.

The cover element forming part of the system can be provided in the form of a two-dimensional, substantially plane geometry, which makes said element easy and inexpensive to distribute and handle prior to mounting, during which it is unfolded in one simple operation to form a three-dimensional geometry, which can be mounted directly or after slight cutting/folding thereof. Also the diffusion and airsealing film may be provided in the form of goods sold by the meter, which are distributed on rolls to the site of mounting.

The system and cover element are easy to mount, since the cover element, in its unfolded, three-dimensional state, forms large, substantially plane surfaces, which may be arranged to cover the leaks occurring when cutting out and folding in the diffusion and airsealing film that is mounted initially over the wall portion from which the beam portions project. The time-consuming and trying work of cutting and mounting additional pieces to cover the leaks is hereby eliminated. The only supplementary work needed is to secure, for example by means of tape, the edge portions of the cover element to the surrounding surfaces of the diffusion and airsealing film. And this work can be carried out rapidly and without difficulty since all surfaces are large, plane and easily accessible. As a result, the quality of the sealing work is increased, which considerably reduces the risk of substandard sealing, which could lead, for instance, to damage due to moisture and to energy loss.

The cover element forming part of the system has a simple design, which enables straightforward and inexpensive manufacture thereof. Furthermore, a single size of the cover element can be provided and used, since it can be easily adapted to match the current dimensions/geometry of the beam portion. The dimensions/geometry of the beam portion may vary, for example, depending on the type and age of the building, the building standard and the manufacture.

In addition, the cover element may equally well be used for an intermediate floor having a beam portion that projects straight out from a wall portion, a tie beam or a so-called strut or brace wall.

The collar may be formed by a first of the two film portions. As a result of the unfolding of the cover element into its three-dimensional geometry, folding of one of the film portions thus occurs in this embodiment for forming three surfaces that may be arranged against three sides of said beam portion. The folding required to achieve this may occur, for instance, along the interconnected edge portions, which thus form folding lines, as well as along folding lines which in conjunction with the unfolding are formed on the surface of one of the two film portions. The latter folding lines may be fold indications provided beforehand or folding lines formed in conjunction with the unfolding as a result of the geometry of the film portions and edge portions.

The main surface may be formed by a first and a second of said two film portions. This is a result of the cover element being unfolded into its three-dimensional geometry, whereby folding of at least one of the two film portions occurs for forming of said main surface. The folding may, for example, occur along the edge portions along which the film portions are interconnected and which form folding lines, whereby the two film portions are folded away from each other 180 degrees at these edge portions to form a plane main surface.

The main surface and the collar may form, in the unfolded state of the cover element, four mutually orthogonal surfaces. Three of these surfaces are intended to abut against three sides of the beam portion while the fourth surface is intended to abut against the wall portion from which the beam portion projects. In the case where the intermediate floor has right-angled components, which is usually the case, the orthogonal surfaces enable the sealing element to be mounted directly without adapting it by means of supplementary folding lines. The only adaptation required is basically to adjust the size of the surfaces depending on the desired overlap relative to the surrounding diffusion and airsealing film and the current height of the beam portion. Should any angle discrepancies occur the cover element, because it is made of flexible film, can easily be provided with new folding lines or be cut accordingly.

The main surface may be arranged to connect onto the diffusion and airsealing film stretched over the wall portion for forming a satisfactory seal against said film.

The system may further comprise a sealing material adjacent said intersection between the cover element and the diffusion and airsealing film. The sealing material, which is used to ensure satisfactory sealing, may be, for example, tape, jointing compound or sealing strips.

The cover element may comprise adhesive-coated portions along at least some of the edge portions of the unfolded cover element. This allows rapid and easy adhesion to the surrounding diffusion and airsealing film, whereby the use of supplementary sealing material can be limited to such instances where the circumstances dictate the use thereof.

The edge portions along which the film portions are interconnected may, in the non-unfolded state of the cover element, form an isosceles trapezoidal recess, the short side of which has a length corresponding to the width of said beam portion. As a result the cover element will, in its unfolded state, provide an excellent fit with three sides of the beam portion.

The cover element may, in its non-unfolded state, comprise parallel folding lines, which extend radially from the bottom of said isosceles trapezoidal recess at a distance relative to one another corresponding to the width of said beam portion. Folding lines of this kind ensure a better fit with the beam portion in the unfolded state of the cover element.

The system typically comprises two cover elements, the collars of the respective cover elements being arranged to enclose said beam portion from two opposite directions. In this case, the collars may advantageously be arranged so as to enclose said beam portion in an overlapping manner. The beam portion is thus enclosed and encapsulated in a simple manner, and sealing can be effected using a suitable sealing material.

According to another aspect, the invention relates to a cover element for airtight sealing of leaks at an intersection between a wall portion and a beam portion projecting from the wall portion. The cover element is characterised by two flexible film portions, which are connected to each other along a first edge portion, the film portions comprising folding lines to enable unfolding of the cover element for forming a three-dimensional geometry including a main surface and a collar which projects from the main surface and is formed integrally therewith and which corresponds to three sides of said beam portion.

The advantages of such a cover element have been discussed above in conjunction with the discussion relating to the advantages of a system comprising such a cover element, and reference is therefore made to that stated above.

Each film portion may, in the non-unfolded state of the cover element, have the shape of two triangles, which along their respective bases form a first surface, said bases being linearly separated from one another by a distance corresponding to the width of said beam portion for forming an isosceles trapezoidal recess in each film portion.

The edge portions along which said film portions are interconnected may form said isosceles trapezoidal recess, and the short side of the isosceles trapezoidal recess may have a length corresponding to the width of said beam portion.

A first one of said two film portions may, in the unfolded state of the cover element, form said collar and the first film portion in combination with the second film portion may form said main surface.

DESCRIPTION OF DRAWINGS

The invention will in the following be described in more detail by way of example and with reference to the accompanying drawings, which illustrate a currently preferred embodiment.

TECHNICAL DESCRIPTION

Figure 1:
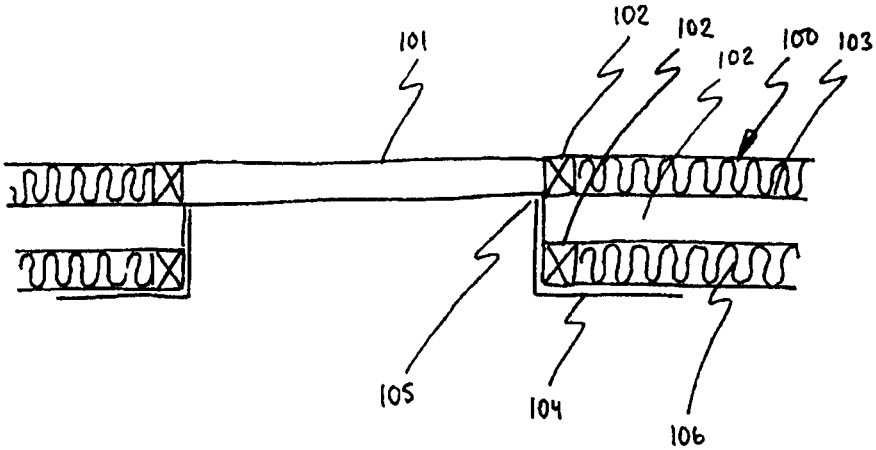
FIG. 1 illustrates schematically an example of a wall portion in which a window is mounted.

With reference to FIG. 1, an example of a wall portion 100 in which a window is mounted 101 is shown highly schematically. No ventilation gap and no facing are shown. The wall portion 100 is made up of a framework 102 consisting of, for example, wood studs, forming a stud wall 103. The actual window 101 is fixedly mounted in the stud wall 103 by the frame of the window 101 being fixedly mounted in the surrounding studs. To provide a wind and diffusion shield, a diffusion and air sealing film 104 is attached to the stud wall 103. In connection with the building corners 105, which are formed where at least three surfaces meet, the diffusion and air sealing film 104 is folded in. The diffusion and air sealing film 104 has vapour retarder or vapour barrier properties and can be made of, for example, plastic film, aluminium foil, kraft paper or laminates of one of these materials. Laminates, if any, can be provided with a reinforcing carrier layer. The stud wall 103 is further insulated with an insulating material 106 which is arranged in the framework 102.

Figure 2:
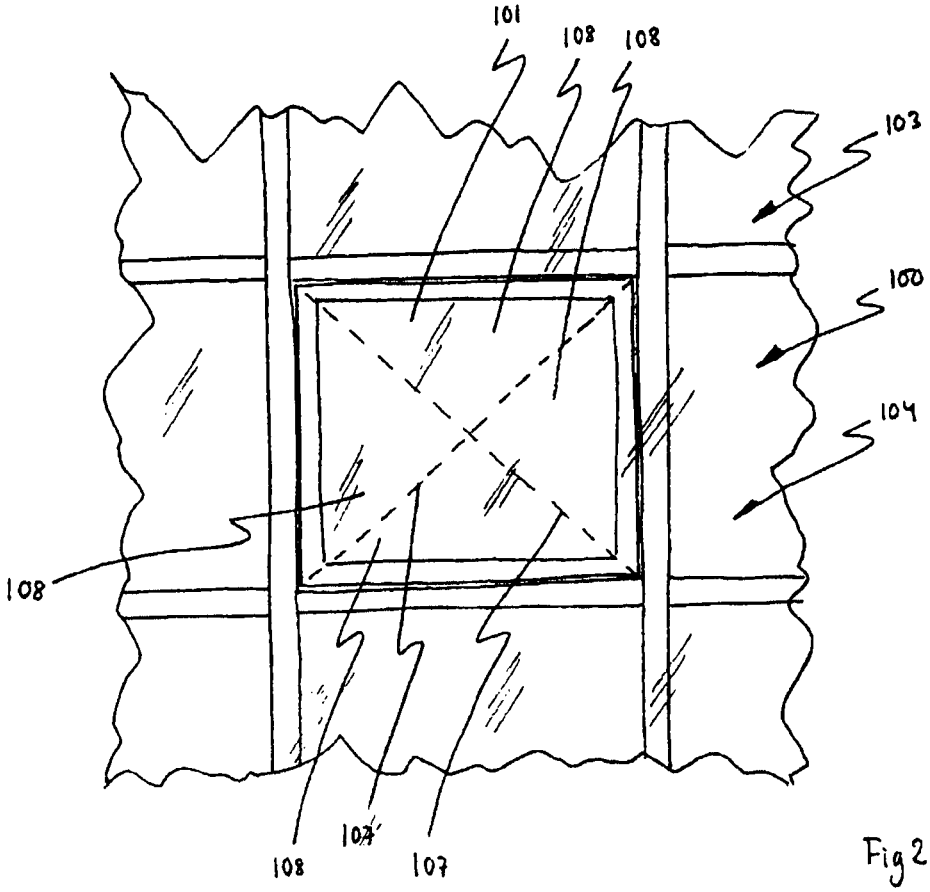
FIG. 2 illustrates schematically a wall portion with an attached, cut diffusion and air sealing film.
Figure 3:
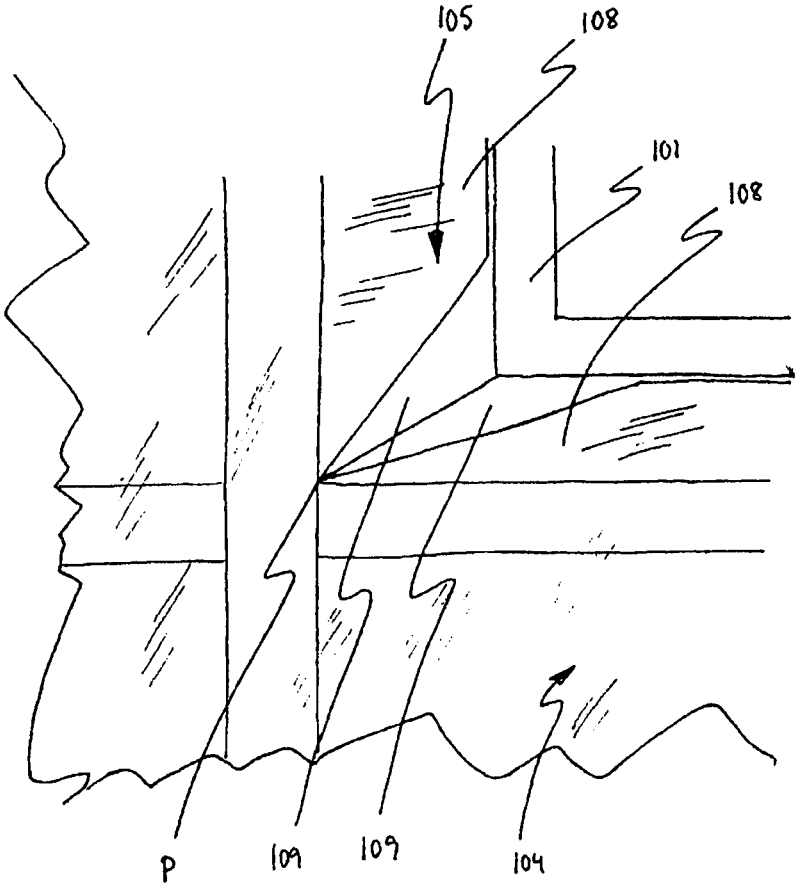
FIG. 3 illustrates schematically a building corner with a cut and folded diffusion and air sealing film and the resulting leaks.

In mounting the diffusion and air sealing film 104, this is usually attached to the stud wall 103 and the window 101 mounted therein, after which two diagonal cuts 107 are made in the film so that four triangular flaps 108 are formed, see FIG. 2. The flaps 108 are then folded into the window bay and the building corners 105 and attached to the walls thereof, after which residual material in the tips of the flaps is removed, see FIG. 3. In this method, there is, however, no diffusion and air sealing film 104 in the building corners 105 at the basis of the flaps, resulting in leaks 109 where moisture can enter and heat can escape. These leaks 109 are usually sealed according to prior art technique by means of pieces of diffusion and air sealing film, adhesive tape, sealing strip or jointing material. Sealing often occurs very arbitrarily since there are no standards and guide lines and no completed sealing elements either. Furthermore the work often occurs against the clock, which in itself often results in insufficient sealing. Finally, the inside of walls, window bay etc is cladded with material in the form of, for example, paper-coated gypsum boards, borders, panels or other wall lining, which in itself makes inspection of the sealing work very difficult.

In the following a first embodiment of a cover element 1 according to the present invention will be described with reference to FIGS. 4*a*-4*d* where the two-dimensional and three-dimensional geometries of the inventive cover element are shown. The inventive cover element is in fact adapted to be provided as a two-dimensional geometry which in connection with mounting is folded to form a three-dimensional geometry.

Figure 4A:
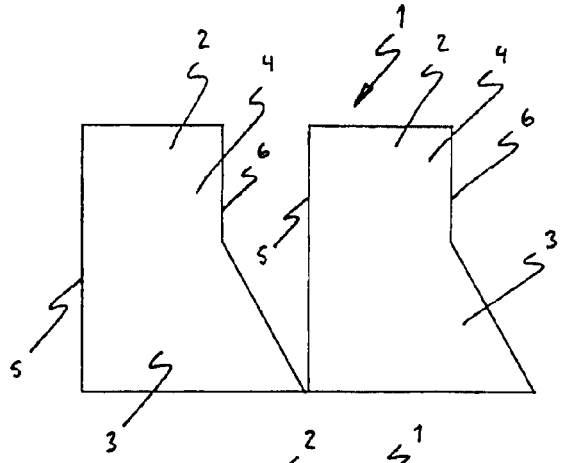
FIGS. 4*a*-4*d* illustrate a first embodiment of the inventive cover element.

In its simplest, first embodiment, the cover element 1 comprises in its two-dimensional geometry, see FIG. 4*a*, two identical flexible film portions 2 which are arranged one on top of the other. For purposes of illustration, each film portion 2 can, with reference to FIGS. 4*a*-4*c*, geometrically seen be divided into a trapezoid 3 provided with a right-angled corner and changing into a right-angled quadrangle 4. More specifically, the trapezoid 3 changes into the right-angled quadrangle 4 along the shorter of the two parallel sides of the trapezoid. This gives each film portion 2 the shape of a "boot" with a straight first rim portion 5 and an opposite angular second rim portion 6.

The two film portions 2 are interconnected by means of seam welding along the angular second rim portion 6. The weld can be divided into two linear weld joints 7 which both extend along the angular second rim portion 6 from a point of intersection P. Geometrically seen, the point of intersection P is arranged along the second rim portion in the transition between the right-angled quadrangle 4 and the angular side of the trapezoid 3.

Figure 4B:
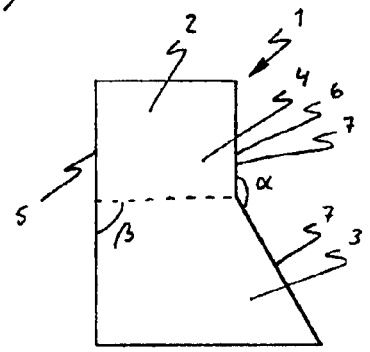
Figure 4C:
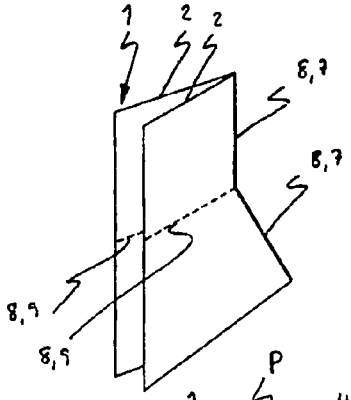

The cover element 1 comprises four linear fold lines 8, see FIG. 4*c*, which all start from the point of intersection P, of which two are pure fold lines 9 and two are formed by said weld joints 7. The two pure fold lines 9, which are arranged in the respective film portions 2, extend across the cover element between the first 5 and the second 6 rim portion from the point of intersection P, that is along the transition between the right-angled quadrangle 4 and the trapezoid 3. In the shown embodiment, these two fold lines 9 intersect the first rim portion 5 at right angles β. The purpose of the four fold lines 7, 8, 9 is to allow folding of the cover element from a two-dimensional to a three-dimensional geometry.

Figure 4D:
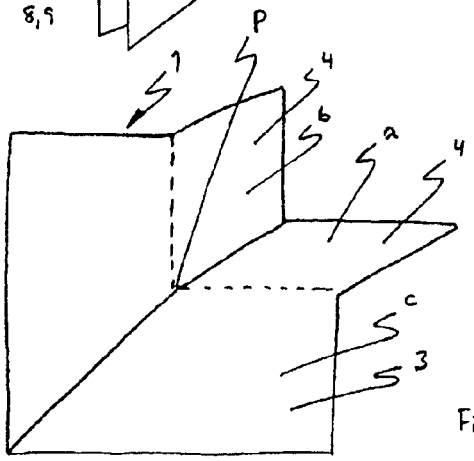

The cover element is adapted to be provided in its two-dimensional geometry and then, in connection with mounting in a building corner, be folded to form a three-dimensional geometry by folding along the fold lines, see FIG. 4*d*.

The cover element 1 forms in its folded, three-dimensional geometry three interconnected, essentially flat surfaces a, b, c which meet at the point of intersection P. In the three-dimensional geometry, the point of intersection P is to be found in the centre of the three-dimensionally folded cover element 1. Two of the surfaces a, b are formed by the two right-angled quadrangles 4, while the third surface c is formed together by the two trapezoids 3.

Figure 5:
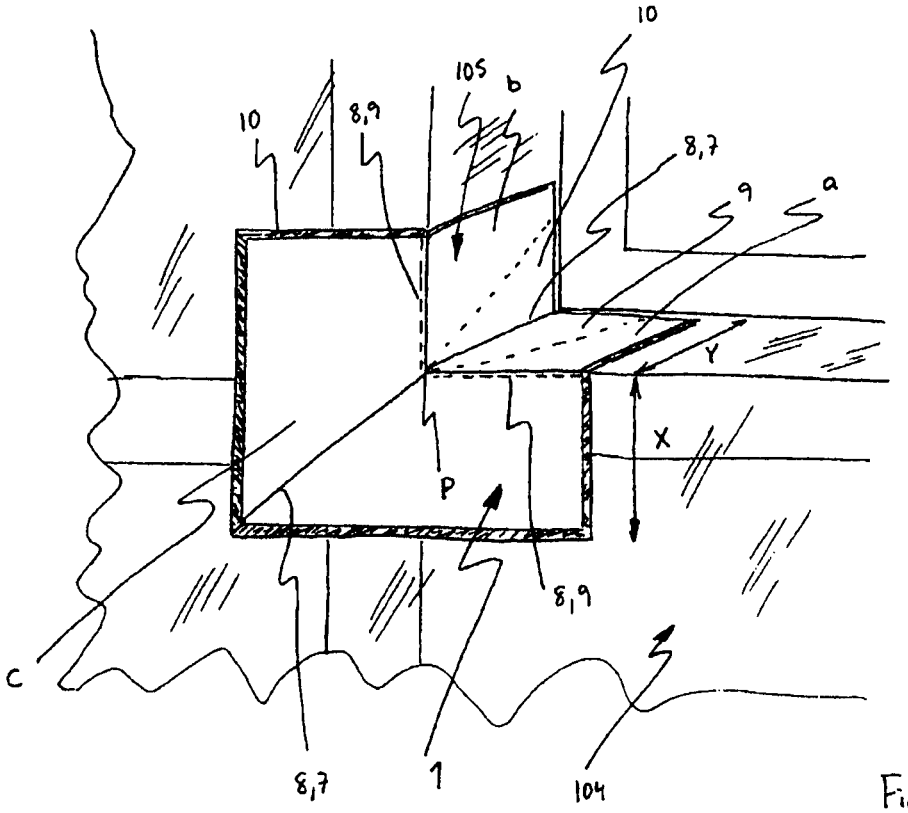
FIG. 5 shows the cover element mounted in a building corner.

With reference to FIG. 5, the cover element 1 is adapted to be mounted in a building corner 105 in such a manner that three of the four fold lines 7, 8 9 are arranged over the edges of the building corner 105, while the fourth fold line 8 which consists of a weld joint 7 is arranged along the plane of the surrounding wall. The two surfaces a, b which are formed by the right-angled quadrangles 4 will thus cover the previously discussed leaks 109 which are formed in cutting and folding of the diffusion and air sealing film 104.

In dependence on the chosen angle α formed between the two weld joints 7 that meet at the point of intersection P, see FIG. 4*b*, and thus the angle of the angular second rim portion 6, the three surfaces a, b, c that are obtained in the folded three-dimensional geometry of the cover element 1 can be caused to form three mutually orthogonal surfaces that meet at the point of intersection P, see FIG. 4*d* so as to directly fit in a right-angled building corner. To allow this, the angle α is chosen to be 135°.

It may easily be understood that the angle α can be adjusted in such a manner that the cover element fits in non-right-angled building corners. It will also be understood that the angle β between the pure fold lines 9 and the first rim portion 5 can be adjusted according to the angles of a building corner. This can take place either by the cover element being provided with fold lines with preselected, predetermined angles α and β, or by the fitter in connection with mounting arranging fold lines on his own for adjusting the geometry to the building corner in question.

For a perfect seal, the cover element 1 should overlap the posteriorly situated diffusion and air sealing film 104 in connection with mounting in a building corner 105. This overlap should be somewhere between 100 mm and 450 mm, see FIG. 5. This overlap is obtained with the length X, Y of the rim portions of the film portions. The cover element can advantageously be provided with an oversized length of the parts of the rim portions which are adapted to be oriented towards the building corner during mounting, whereby the length can be adjusted by the fitter during mounting in dependence on the depth of the building corner.

Figure 6:
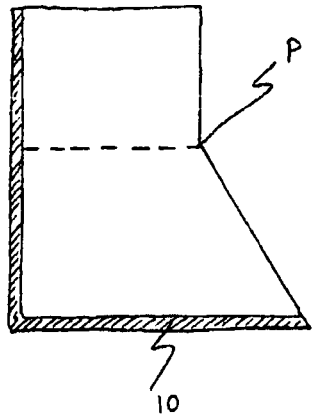
FIG. 6 illustrates schematically a cover element with portions provided with adhesive.

To facilitate mounting of the cover element 1, this may, as shown in FIGS. 5 and 6, comprise portions 10 provided with adhesive along all or some of the rim portions of the three-dimensionally folded cover element. As an alternative to the portions provided with adhesive, an adhesive can be arranged over the entire inner surface of the cover element. The portions provided with adhesive are advantageously coated with a protective film (not shown), which is torn off in connection with mounting. The rim portions which in the three-dimensionally folded state of the cover element are adapted to be oriented towards the building corner can be left without adhesive if the length of the these rim portions in accordance with the discussion above is oversized to allow adjustment to the depth of the building corner in question.

It will be appreciated that the cover element can also be provided without adhesive and instead be attached to the posteriorly situated diffusion and air sealing film by means of adhesive tape, sealing strip, jointing material or the like. It will further be appreciated that the inventive cover element should be supplemented with adhesive tape, jointing material or the like in the innermost part of the building corner.

The flexible film portions 2 advantageously consist of an airtight film with vapour retarder or vapour barrier properties and can be made of, for instance, plastic film, aluminium foil, kraft paper or laminates of these materials. Laminates, if any, can be provided with a reinforcing carrier layer of, for example, glass fibre. The cover element is advantageously made of the same material as the surrounding diffusion and air sealing film. A typical thickness of this type of film is about 0.2 mm. In the case where a laminate is used, this can have a thickness, for instance, in the range 0.15-0.30 mm. However, it will be appreciated that this is an example only.

With reference to FIGS. 7*a*-7*d*, an alternative embodiment of a cover element 1' according to the invention is illustrated. This embodiment differs from the one first described by the way in which the flexible film portions are configured and joined to form the above described two-dimensional geometry in the form of a "boot".

The two-dimensional geometry is here created by two flexible film portions 2'. The first film portion is a right-angled quadrangle 4' folded in two. The second film portion is also folded in two and forms in its state folded in two a trapezoid 3' provided with a right-angled corner. The two film portions 2' are interconnected along two weld joints 7' in order to together form a straight first rim portion 5' and an opposite angular second rim portion 6'. More specifically, the two film portions 2' are joined along the shorter of the two parallel sides of the trapezoid 3'. As a result, the fold lines 9' of the first and the second film portion 2' will meet at the point of intersection P and together form the second rim portion 6'. The two weld joints 7' extend between the first 5' and second rim portions 6' from the point of intersection P. In the embodiment illustrated, the weld joints 7' extend at right angles β to the first rim portion 5'. The weld joints 7' also form fold lines 8'.

Figure 7A:
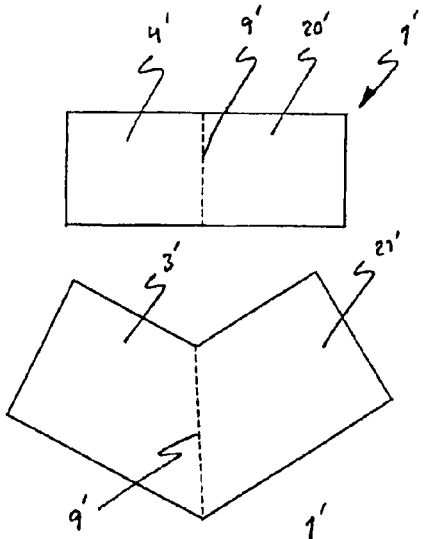
FIGS. 7*a-d* illustrate a second embodiment of the cover element.
Figure 7B:
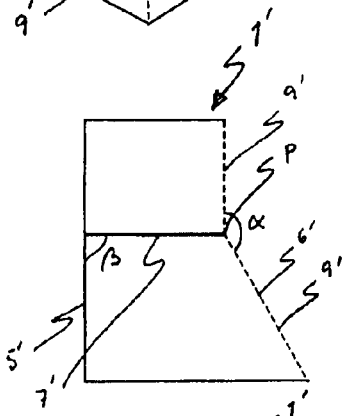
Figure 7C:
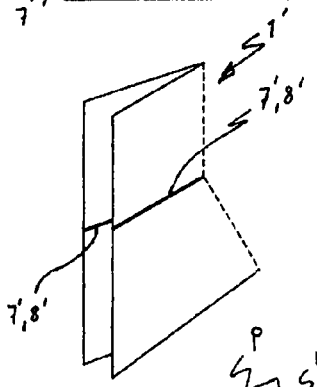
Figure 7D:
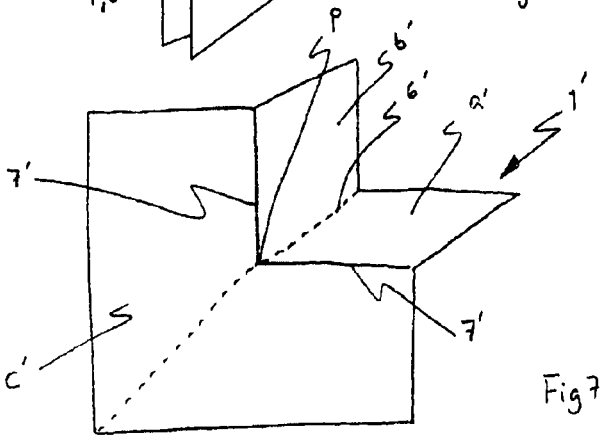

Like in the first described embodiment, the cover element 1' forms in its folded three-dimensional geometry, see FIG. 7*d*, three interconnected surfaces a', b', c' which meet at the point of intersection P, which in the three-dimensional geometry is to be found in the centre of the three-dimensionally folded cover element 1'. Two of the surfaces a', b' are formed by the three-dimensionally folded right-angled quadrangle 4' while the third surface 3' is formed by the three-dimensionally folded trapezoid 3'. The three-dimensional folding of the cover element 1' thus occurs along the angular second rim portion 6' and the two weld joints 7'.

With reference to FIGS. 8*a*-8*d*, another alternative embodiment of a cover element 1" according to the invention is shown.

Figure 8A:
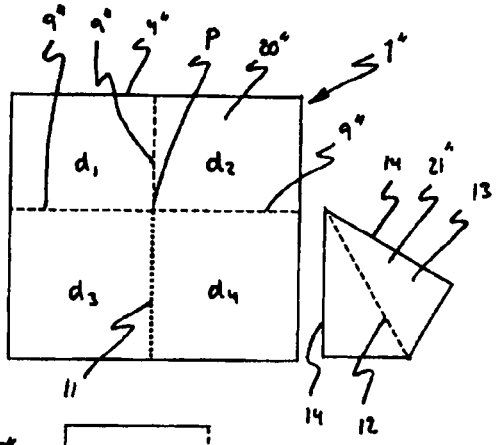
FIGS. 8*a-d* illustrate a third embodiment of the cover element.

The two-dimensional geometry is here too created by two flexible film portions 20", 21", see FIG. 8*a*. The first film portion 20" consists of a first right-angled quadrangle 4" which comprises three linear fold lines 9" which meet at right angles at the point of intersection P in the centre of the surface of the quadrangle. The point of intersection P can be arranged, for example, in the centre of the quadrangle. Furthermore the first film portion 20" comprises a straight slit 11 which extends at right angles from a rim portion to the point of intersection P. The slit 11 and the three fold lines 9" together divide the first film portion 20" into four quadrants $d_1$-$d_4$.

The second film portion 21" has the form of a right-angled triangle 13 folded in two along the hypotenuse 12.

Figure 8B:
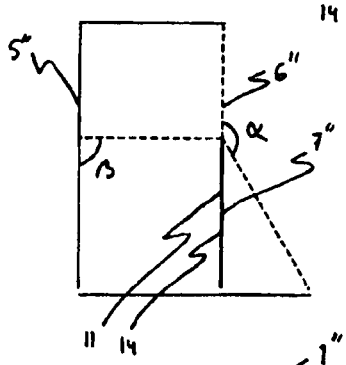
Figure 8C:
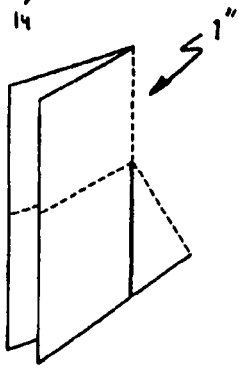
Figure 8D:
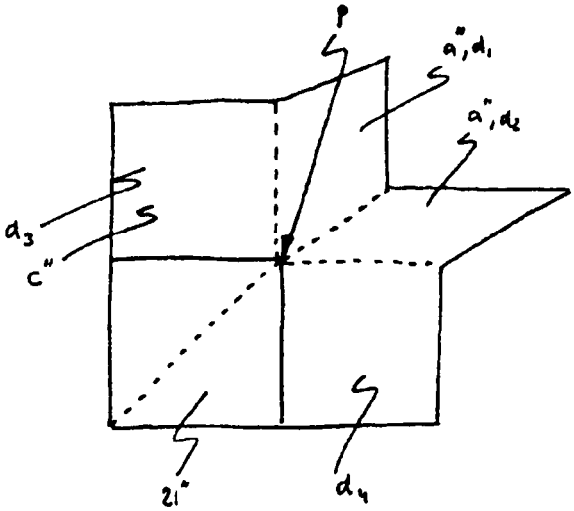

The first and the second film portion 20", 21" are interconnected by seam welding by the legs 14 of the second film portion 21" being welded each to one side of the slit 11 of the first film portion 20", see FIG. 8*b*. This means that the cover element 1" in its two-dimensional position obtains the previously described geometry in the form of a "boot" with a first straight rim portion 5" and an opposite angular second rim portion 6".

One of the fold lines 9" of the quadrangle 4" meets at the point of intersection P the fold line which is arranged along the hypotenuse 12 of the second film portion 12" folded in two in order to form the above described angular second rim portion 6". The other two fold lines 9" of the quadrangle 4" extend between the first 5" and the second rim portion 6" from the point of intersection P at right angles β to the first rim portion 5". All fold lines 9" and weld lines 7" thus meet, in accordance with previous embodiments, at the point of intersection P.

When folding the cover element 1" from its two-dimensional geometry to its three-dimensional geometry, three-dimensional folding takes place along the fold lines 9" of the first film portion 20" and the fold line arranged along the hypotenuse 12 of the second film portion 21" folded in two. Thus the two surfaces a", b" of the three-dimensional geometry will be formed by two quadrants $d_1$,$d_2$ of the first film portion 20". The third surface c" will be formed by the remaining two quadrants $d_3$,$d_4$ of the first film portion 20" together with the three-dimensionally folded second film portion 21". Like in the above described embodiments, the cover element 1" forms in its folded three-dimensional geometry three interconnected surfaces a"-c" which meet at the point of intersection P which is to be found in the centre of the cover element 1".

In contrast to the above described embodiments, the weld lines 7" do not form fold lines in this embodiment.

With reference to that stated above, three different embodiments of a cover element according to the present invention have been described.

Like in the first embodiment, the angles α and β can in the second and third embodiments be varied to adjust the cover element to non-orthogonal building corners.

Figure 9A:
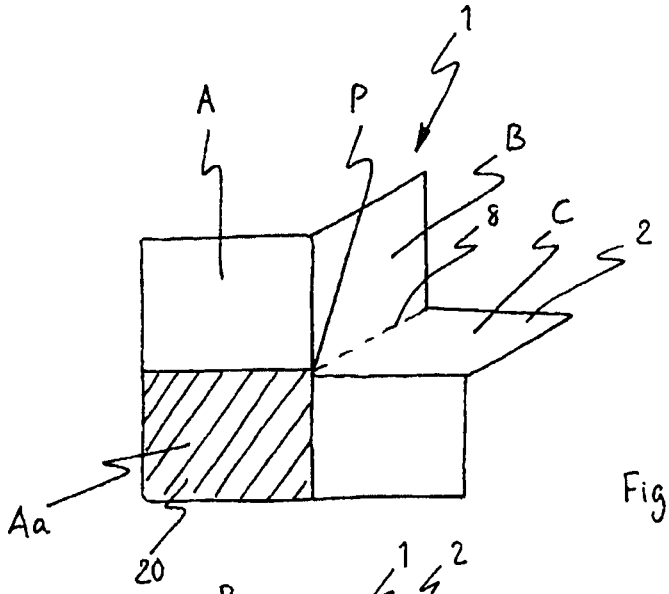
FIGS. 9*a-c* illustrate additional embodiments.
Figure 9B:
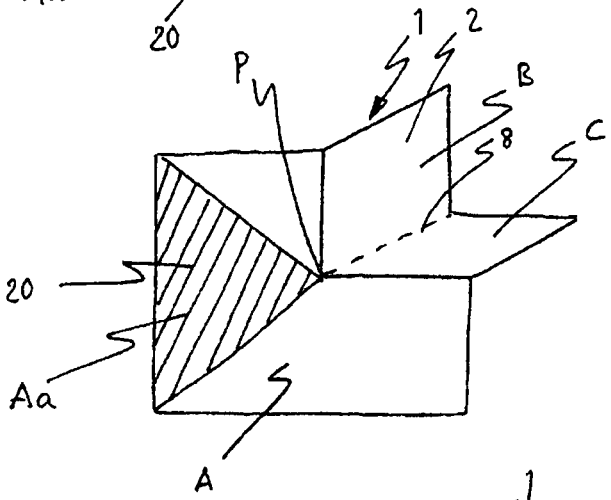

It will be appreciated that these are only three conceivable embodiments and that the two-dimensional geometry itself can be varied within the scope of invention to allow folding to form a three-dimensional geometry which has three surfaces meeting at a point of intersection P. For instance, FIGS. 9*a* and 9*b* illustrate highly schematically two such embodiments of a cover element 1 which is folded to form a three-dimensional geometry.

The cover element is formed by a first film portion 2 and a second film portion 20. The first film portion 2 is folded along a fold line 8. The second film portion 20 is by welding joined to the first film portion 2 to form, together with this, a surface A. More specifically, the second film portion 20 forms a surface segment Aa. The first film portion 2 thus forms the surfaces B and C and together with the second film portion 20 the surface A. All three surfaces A, B, C meet at the point of intersection P.

Figure 9C:
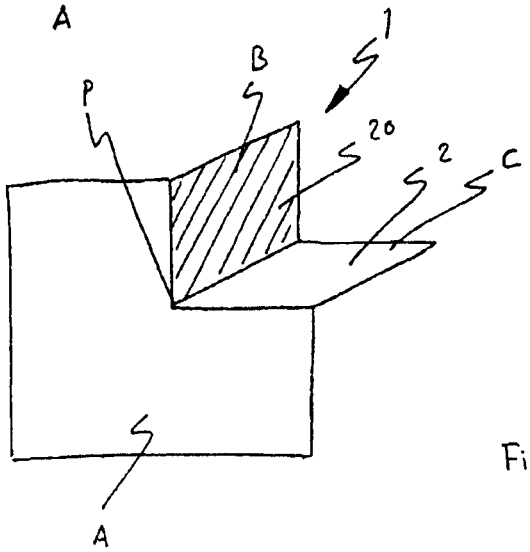

Another variant is shown in FIG. 9*c*, in which a first 2 and a second film portion 20 are welded together to form three surfaces A, B, C which in the three-dimensionally folded state of the cover element 1 meet at the point of intersection P. Alternatively, the respective surfaces A, B, C can consist of separate welded together film portions.

Thus several modifications and variations are feasible and therefore the invention is exclusively defined by the appended claims.

Figure 10:
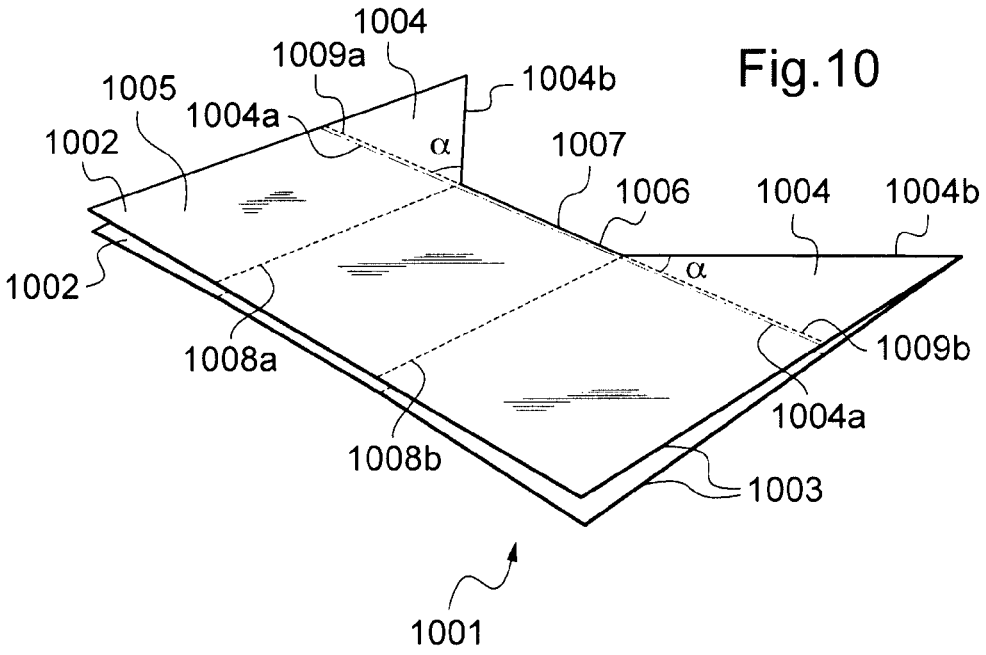
FIG. 10 schematically illustrates a particular embodiment of the cover element in its plane state before being unfolded to form a three-dimensional geometry.

With reference to FIG. 10, an embodiment of the cover element 1001 in its plane state prior to unfolding is shown. In the illustrated embodiment, the cover element 1001 is made up of two plane, flexible film portions 1002, which are arranged on top of each other such that their edge portions 1003 coincide.

Each film portion 1002 can be geometrically divided into two right-angled triangles 1004, each with a base 1004*a* and a hypotenuse 1004*b*. The triangles 1004 are oriented such that their respective bases 1004*a* form a first surface 1005, which in the illustrated embodiment is rectangular. In FIG. 10, the division into triangles 1004 and said first surface 1005 is indicated by a dashed and dotted line. The bases 1004*a* of the two triangles 1004 are separated from one another along one side of the first surface 1005. The distance between the two bases 1004*a* corresponds to the width of the beam portion which is to be covered by the cover element and which will be described below. The hypotenuses 1004*b* of the triangles 1004 form, together with the first surface 1005, an isosceles trapezoidal recess 1006. The edge portion 1007 of this recess 1006 constitutes a welding joint along which the two film portions 1002 are interconnected. It will be appreciated, however, that joining methods other than welding are possible.

The first surface 1005 is described above as being rectangular. It will be appreciated, however, that it may have any arbitrary shape, since its function is to form, with the cover element in its mounted state, a surface that may overlap the substrate onto which the cover element is applied. This is true also for the two triangles 1004, which may have any arbitrary geometry.

In a preferred embodiment, the isosceles trapezoidal recess 1006 has an angle $\alpha$ of 45 degrees, i.e. the angle between the base 1004*a* and the hypotenuse 1004*b* of the respective triangle. An advantage associated with an angle of this magnitude is that the cover element, in its unfolded state, will have mutually orthogonal surfaces.

Advantageously, at least one of the two film portions 1002 may comprise a first set of folding lines 1008*a*, 1008*b* in the form of two parallel folding lines, as indicated by dashed lines, which extend from the bottom of said isosceles trapezoidal recess 1006 at a distance from one another corresponding to the width of said beam portion. These folding lines extend towards the first surface 1005 and suitably originate at the point of intersection between the base 1004*a* and the hypotenuse of the respective triangle.

The same film portion 1002 may further comprise a second set of folding lines 1009*a*, 1009*b*, which follow the base 1004*a* of the respective triangle 1004.

The first and second sets of folding lines 1008*a*, 1008*b*, 1009*a*, 1009*b* may, for instance, be preformed crease lines or faint fold indications, such as printed lines, to facilitate the skilled person's understanding of how the cover element is to be unfolded. It will be appreciated that they may also be omitted entirely.

Advantageously, the flexible film portions 1002 consist of an airtight film with vapour retarder or vapour barrier properties and may be made of, for example, plastic sheeting, aluminium sheeting, kraft paper or a laminate of these materials. The laminates, if any, may be provided with a reinforcing backing made, for example, of glass fibre. This is the same type of material that is commonly used in the diffusion and airsealing films available on the market, which means that the fitter may simply use the same types of tape, jointing compound and the like that are already at his disposal for other sealing work. Moreover, the properties of the final diffusion seal are not affected, since no new material types are added.

Advantageously, the cover element is made of the same material as the surrounding diffusion and airsealing film. A typical film thickness is here about 0.2 mm. In the case where a laminate is used, it may have a thickness in the range of 0.15-0.30 mm. It will be appreciated, however, that these figures serve as examples only.

Figure 11:
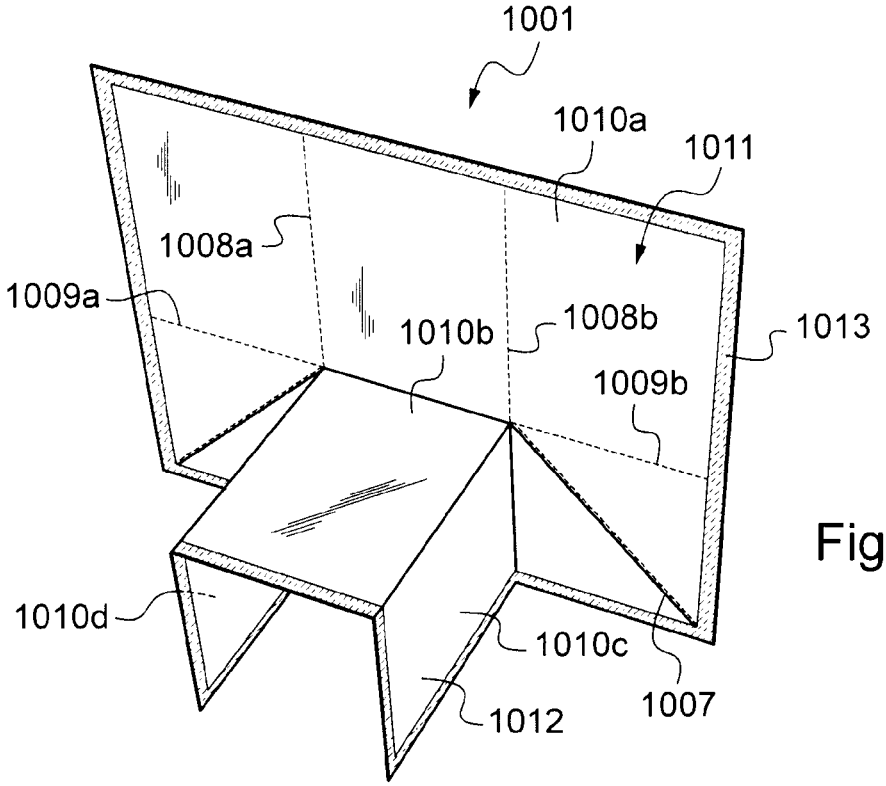
FIG. 11 illustrates the same cover element when unfolded to form a three-dimensional geometry.

The inventive cover element 1001 is adapted to be provided as a two-dimensional geometry which when mounted is unfolded to form a three-dimensional geometry, see FIG. 11. In its unfolded state, the three-dimensional geometry forms four mutually orthogonal surfaces 1010*a-d*, as will be explained below.

In connection with the unfolding, a folding occurs along the edge portion 1007 formed along the isosceles trapezoidal recess 1006, i.e. along the welding joint. The edge portion 1007 is illustrated schematically in FIG. 11 as a dotted line.

The folding along said edge portion 1007 occurs in such a manner that the two film portions 1002 are moved apart, whereby both film portions are folded outwards so that they together form a substantially plane main surface 1011. Thus, a folding of 180 degrees occurs at this edge portion 1007.

The film portion 1002 adapted to form a collar 1012 in conjunction with the unfolding is folded along the first and second sets of folding lines 1008*a*, 1008*b*, 1009*a*, 1009*b*, see the dashed lines in FIG. 11. Should the film portion lack preformed folding lines said folding lines will be formed automatically upon unfolding due to the recessed geometry of the cover element. However, there will be no distinct transition between the orthogonal surfaces 1010*a-d* thus formed.

To obtain the unfolded three-dimensional geometry, a folding of 180 degrees has thus occurred along the two parts of the edge portion 1007 of the isosceles trapezoidal recess 1006 that are formed along the interconnected film portions 1002. Furthermore, a folding of 90 degrees occurs along respectively the first and the second set of folding lines 1008*a*, 1008*b*, 1009*a*, 1009*b*.

This results in a three-dimensional geometry having a substantially plane, main surface 1011 and a collar 1012 which is formed integrally therewith and projects from the main surface. The cover element 1001 thus has four mutually orthogonal surfaces 1010*a-d*, of which one surface forms the main surface 1011 and three surfaces form the collar 1012.

To facilitate mounting, the cover element 1001 may comprise, as shown in FIG. 11, adhesive-coated portions 1013 along all or some of the edge portions 1003 of the unfolded cover element. As an alternative to the adhesive portions 1013, an adhesive may be applied over the whole inner surface of the cover element. Advantageously, the adhesive portions are provided with a protective film (not shown), which is torn off in connection with mounting.

It will be appreciated that the cover element 1001 may be provided without an adhesive and instead be adapted for attachment to the underlying diffusion and airsealing film by means of any suitable sealing material such as tape, sealing strips, jointing compound or the like. It will also be appreciated that the inventive cover element may well be supplemented with tape, jointing compound or the like also in the case where it does have adhesive-coated portions.

Owing to its flexible construction, the cover element 1001 can be folded into its three-dimensional geometry from both directions, i.e. the collar 1012 may be formed by either the first or the second of the two film portions 1002. This means that it is sufficient for the above-mentioned adhesive portions to be arranged on one side, since the cover element can always be folded in such a manner that the adhesive portions are facing the surface to which the cover element is to be attached, no matter whether this is an underlying diffusion and airsealing film or an overlapping second cover element.

Figure 12:
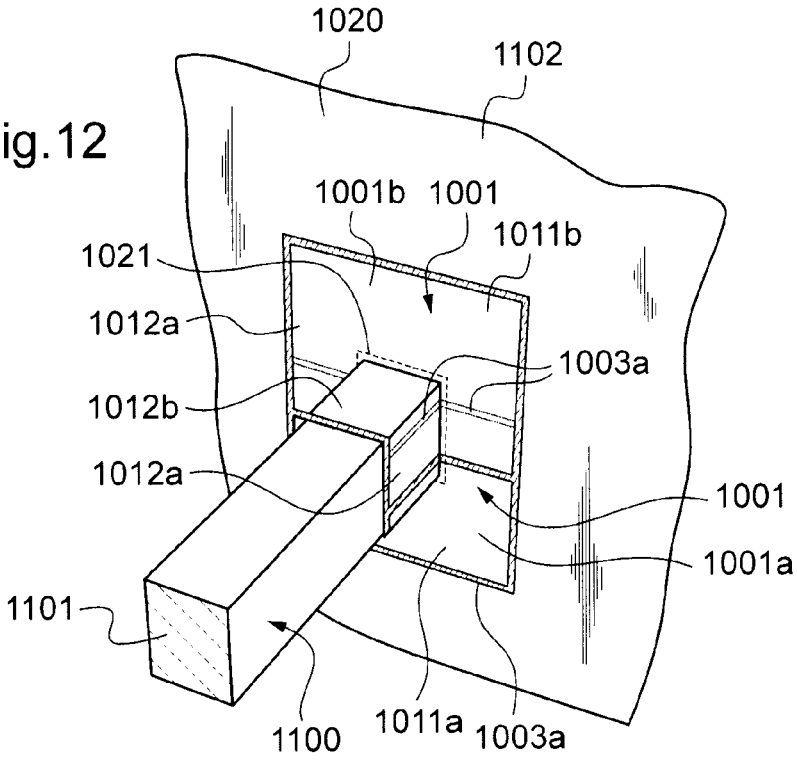
FIG. 12 schematically illustrates the cover element when arranged adjacent an intermediate floor.

With reference now to FIG. 12, a first application of the present cover element 1001 is shown when mounted adjacent an intermediate floor 1100, where a beam portion 1101 projects straight out from a surrounding wall portion 1102. An intermediate floor 1100 of this kind is used, for instance, between two storeys of a building. As seen in the longitudinal direction of the building, a number of such beam portions are arranged across the building between its walls. For the sake of clarity, however, only one beam portion and one wall portion are shown.

Before applying the cover element 1001 and for the purpose of providing an air and diffusion barrier, a diffusion and airsealing film 1020 is initially stretched over the surrounding wall portion 1102 formed between the separate beam portions. Recesses 1021 are formed in the film 1020 adjacent the associated beam portion 1101 so as to allow the beam portion to protrude there through. The diffusion and airsealing film 1020 is attached to adjacent joists (not shown).

The cover element 1001 is then mounted so as to form a cladding of the beam portion 1101 at the intersection with the wall portion 1102. This is achieved by a first cover element 1001*a* being mounted from a first side of the beam portion 1101, which operation is performed, in the illustrated embodiment, from the underside of the beam portion. The cover element 1001*a* is arranged such that its main surface 1011*a* engages the surrounding diffusion and air sealing film 1020 and that its collar 1012*a* encloses three sides of the beam portion 1101. The edge portions 1003*a* of the cover element 1001*a* are attached to the surrounding diffusion and airsealing film 1020 and the sides of the beam portion, respectively. Attachment may be effected either by the cover element being, in itself, provided with an adhesive or by using separate means of attachment, such as staples, tape or the like. Advantageously, the tape may consist of double-stick sealing strips.

A second cover element 1001*b* is then arranged in a corresponding manner against the opposite side of the beam portion 1101, i.e. from its upper side in the embodiment shown, such that the main surface 1011*b* of the second cover element 1001*b* engages with the underlying diffusion and airsealing film 1020 and that its collar 1012*b* encloses three sides of the beam portion 1101. The second cover element 1001*b* is correspondingly attached to the surrounding diffusion and airsealing film 1020 but also to the underlying first cover element 1001*a*. Attachment may be effected either by the cover element being, in itself, provided with an adhesive or by using separate means of attachment, such as staples, tape or the like.

Finally, if desired, a horizontal diffusion and air sealing film (not shown) may be stretched over the beam portions and attached thereto for forming a horizontal continuous sealing surface.

The joints between the cover element and the underlying diffusion and airsealing film are sealed by applying a suitable sealing material, such as tape, sealing strips, jointing compound or the like.

The two, thus overlapping cover elements, in cooperation with the surrounding diffusion and airsealing film, enable rapid, easy and complete cladding of the intermediate floor and adjacent wall portion.

It will be appreciated that the opposite principle may be used, i.e. that the fitter first mounts the cover elements and then stretches a diffusion and airsealing film over the adjacent wall portions. This opposite principle is applicable in the case where there is an abutment for the main surfaces of the cover elements.

Figure 13:
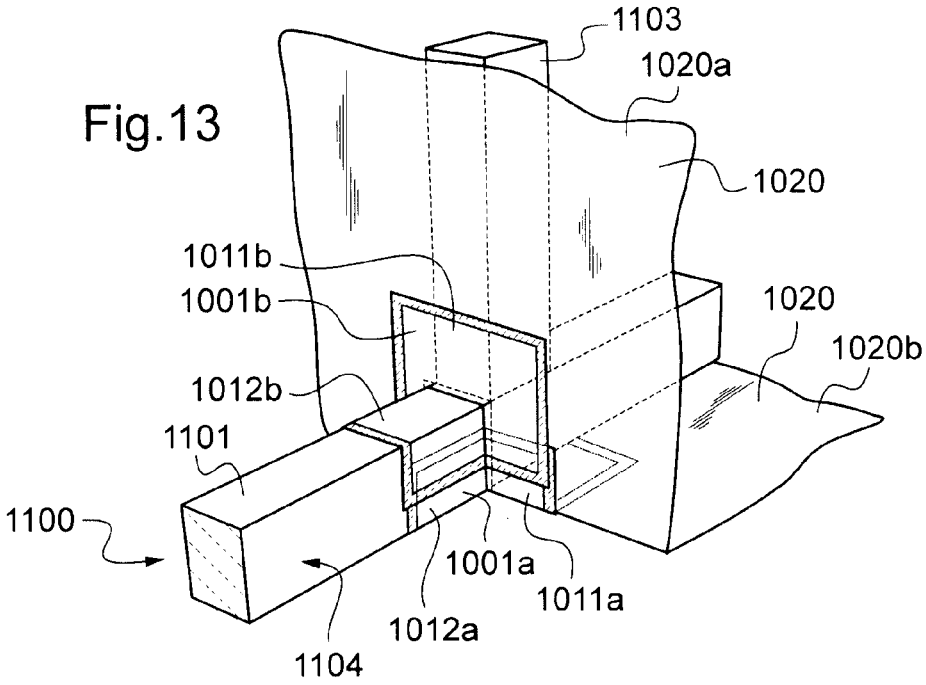
FIG. 13 schematic illustrates the cover element when arranged adjacent a brace wall.

With reference to FIG. 13, an example of the use of a cover element 1001 according to the present invention is shown as applied to a beam portion 1101 of a brace wall 1104. A typical example of a brace wall is found in connection with a roof truss. Each roof truss usually comprises a strut or brace extending upwards to connect the horizontal beam of the roof truss with the crossbeams of the roof truss. This will be referred to below as a brace wall.

For the sake of simplicity, the brace wall 1104 is illustrated only in the form of a part of a horizontal beam portion 1101 in combination with a part of a vertical brace 1103.

When applying cladding to such a brace wall 1104, and for the purpose of providing an air and diffusion barrier, a diffusion and airsealing film 1020 is stretched over the surrounding wall portions formed between the braces of adjoining roof trusses. In this way, a vertical continuous surface 1020*a* and a horizontal continuous surface 1020*b* are formed between adjoining roof trusses. The horizontal continuous surface is formed on the underside of the roof truss.

The brace wall 1104 may, before or after cladding, have or be provided with an insulating material (not shown).

At each beam portion 1101, a first cover element 1001*a* is then mounted from a first side of the beam portion 1101, the underside of the beam portion in the embodiment shown, such that the collar 1012*a* of the cover element encloses three sides of the beam portion 1101 and that the main surface 1011*a* of the cover element extends along the horizontal continuous surface 1020*b* of the diffusion and airsealing film 1020 described above. The cover element 1001*a* is attached to the beam portion and the surrounding diffusion and airsealing film by means of, for example, staples, tape, adhesive or jointing compound.

A second cover element 1001*b* is then mounted from the opposite side of the beam portion 1101, the upper side of the beam portion in the embodiment shown, such that the collar 1012*b* of the cover element encloses three sides of the beam portion and that the main surface 1011*b* of the cover element extends along the vertical continuous surface of the diffusion and airsealing film 1020 described above. The cover element 1001*b* is attached to the beam portion and to the surrounding film by means of, for example, staples, tape, adhesive or jointing compound.

Finally, a horizontal film (not shown) may be stretched over the beams and attached thereto for forming a horizontal continuous surface.

If required, the joints between the cover element and the underlying diffusion and airsealing film may be sealed by applying a suitable sealing material, such as tape, sealing strips, jointing compound or the like.

Accordingly, in a brace wall 1104 a folding of the main surface 1011*a*, 1011*b* occurs in at least one cover element 1001*a*, 1001*b*, causing said surface to extend over both the horizontal and the vertical continuous surface 1020*a*, 1020*b* of the diffusion and airsealing film 1020.

The two, thus overlapping cover elements 1001*a*, 1001*b*, in cooperation with the surrounding diffusion and airsealing film 1020, enable rapid, easy and complete cladding of a brace wall and the adjacent intermediate floor.

It will be appreciated that the opposite principle may be used, i.e. that the fitter first mounts the cover elements and then stretches a diffusion and airsealing film over the adjacent wall portions formed between the braces of adjoining roof trusses. This opposite principle is applicable in the case where there is an abutment for the main surfaces of the cover elements.

It will be appreciated that due to its flexibility the cover element can be easily adapted to match different geometries and angles of the intermediate floor and the brace wall. Moreover, the cover element may be cut so as to match the current beam height.

To obtain a satisfactory seal, the cover element needs to overlap the underlying diffusion and airsealing film. For a beam with a height of 145 mm, for example, the overlap should be in the range of 0 mm to 145 mm. The cover element may well be overdimensioned in terms of its length, at least in those parts which are intended to form the collar, since this allows the cover element to be adapted by the fitter during mounting according to the prevailing circumstances.

If staples are used they should generally be covered with some form of sealing material.

The invention has been described above with respect to its application on massive wooden beams of square outside cross section. For beams or girders of a different cross section, which is such that external ducts are formed therein, for example I-beams, C-beams or H-beams, it is advantageous, in order to provide a satisfactory seal, to arrange sealing elements which "plug" the ducts for forming a reasonably plane underlying surface, which can then be sealed by means of film stretched over the wall and the inventive sealing element.

It will be appreciated that the illustrated embodiment of the cover element is but one conceivable embodiment and that the two-dimensional geometry, as such, may be varied within the scope of the invention to enable unfolding for forming a three-dimensional geometry including a main surface and a collar which projects from the main surface and is formed integrally therewith and which corresponds to three sides of said beam portion. The flexible film portions may, for instance, be divided into several interconnected sections and the different sections may have a different extension than the one represented in the drawings, as long as the collar and the main surface, respectively, allow an overlap relative to the surrounding diffusion and airsealing film.

Several variations and modifications are thus conceivable and, therefore, the scope of the present invention is defined solely by the appended claims.

The invention claimed is:

1. A system for airtight sealing of leaks, comprising:

at least one cover element, each of the at least one cover elements are configured to be disposed in a folded state configuration and include two overlapping and planar flexible film portions having substantially the same size, the film portions are being connected to each other along edge portions;

linear folding lines being arranged in said film portions of each cover element, a first of the linear folding lines extends an entire longitudinal length of each planar flexible film portion from a first end to a second end, a first of the two overlapping and planar flexible film portions is symmetrical with respect to a second of the two overlapping and flexible film portions about the first linear folding line, wherein the linear folding lines to enable the at least one cover element to be changed from the folded state configuration to an unfolded state configuration, so as to form a three-dimensional geometry including a main surface and a collar having three sides, each of the three sides of the collar are configured to contact and project from the main surface, are formed integrally therewith, and are configured to correspond to three sides of a beam portion; and a diffusion and airsealing film configured to stretch over a wall portion and configured to extend beyond an outer perimeter of each side of the main surface of the at least one cover element along the wall portion, wherein the unfolded cover element is configured to be attached to said diffusion and airsealing film at an intersection between the cover element and the diffusion and airsealing film for airtight sealing of said leaks.

2. A system as claimed in claim 1, wherein said collar is formed by a first one of said two planar flexible film portions.

3. A system as claimed in claim 1 or 2, wherein said main surface is formed by a first one and a second one of said two planar flexible film portions.

4. A system as claimed in claim 1, wherein, in the unfolded state of the cover element, the main surface and each surface of the collar form mutually orthogonal surfaces.

5. A system as claimed in claim 1, wherein said main surface is adapted to connect onto the diffusion and airsealing film stretched over the wall portion.

6. A system as claimed in claim 1, further comprising a sealing material adjacent said intersection between said cover element and said diffusion and airsealing film.

7. A system as claimed in claim 1, wherein said cover element comprises adhesive-coated portions along at least some of the edge portions of the unfolded cover element.

8. A system as claimed in claim 1, wherein, when the cover element is in the folded state configuration, the edge portions along which the planar flexible film portions are interconnected, form an isosceles trapezoidal recess.

9. A system as claimed in claim 8, wherein, when the cover element is in the folded state configuration, said cover element includes parallel folding lines, which extend from the bottom of said isosceles trapezoidal recess at a distance relative to one another.

10. A system as claimed in claim 1, comprising two cover elements, the collars of the respective cover elements being arranged to enclose said beam portion from two opposite directions.

11. A system as claimed in claim 10, wherein the collars are arranged to enclose said beam portion in an overlapping manner.

* * * * *